US008562375B2

(12) United States Patent
Chen et al.

(10) Patent No.: US 8,562,375 B2
(45) Date of Patent: Oct. 22, 2013

(54) ELECTRICAL CONNECTOR ASSEMBLY WITH LED DISPLAY

(75) Inventors: Yong-Jun Chen, ShenZhen (CN); Xian-Kui Shi, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/329,085

(22) Filed: Dec. 16, 2011

(65) Prior Publication Data

US 2012/0156924 A1 Jun. 21, 2012

(30) Foreign Application Priority Data

Dec. 16, 2010 (CN) ..... 2010 1 0591393

(51) Int. Cl.
*H01R 3/00* (2006.01)

(52) U.S. Cl.
USPC ..... 439/488; 439/540.1

(58) Field of Classification Search
USPC ..... 439/76.1, 488–490, 540.1, 676
See application file for complete search history.

(56) References Cited

U.S. PATENT DOCUMENTS

| | | | | |
|---|---|---|---|---|
| 6,688,908 | B2 * | 2/2004 | Wallace | 439/490 |
| 7,005,996 | B2 * | 2/2006 | Cabrera et al. | 340/639 |
| 7,217,152 | B1 * | 5/2007 | Xin et al. | 439/490 |
| 7,416,442 | B1 * | 8/2008 | Liu | 439/540.1 |
| 7,686,643 | B2 * | 3/2010 | Pepe et al. | 439/490 |
| 7,811,120 | B2 * | 10/2010 | Liu | 439/490 |
| 8,007,318 | B1 * | 8/2011 | Dunwoody et al. | 439/607.55 |
| 8,246,397 | B2 * | 8/2012 | Jacks et al. | 439/676 |

FOREIGN PATENT DOCUMENTS

| | | | |
|---|---|---|---|
| CN | 1920376 | A | 2/2007 |
| CN | 101807759 | A | 8/2010 |

* cited by examiner

*Primary Examiner* — Thanh Tam Le
(74) *Attorney, Agent, or Firm* — Wei Te Chung; Ming Chieh Chang

(57) ABSTRACT

An electrical connector assembly includes a bracket arranged along a longitudinal direction thereof with a plurality of connector ports and a LED port opening forwards, a plurality of electrical connectors retained in the connector ports, a shading board disposed with a plurality of cavities and a circuit board retained behind and parallel to the shading board and disposed with a plurality of LEDs on a front face thereof. The plurality of LEDs is received in corresponding cavities of the shading board. The shading board with the circuit board is retained in the LED port by the shading board in a height direction perpendicular to the longitudinal direction.

10 Claims, 7 Drawing Sheets

ELECTRICAL CONNECTOR ASSEMBLY WITH LED DISPLAY

BACKGROUND OF THE INVENTION

1. Field of the Invention

The present invention relates to an electrical connector assembly with LED display which includes a PCB and a shading board.

2. Description of the Related Art

LED indicators are used in many types of electrical connectors to indicate insertion statutes of counter connectors, connection or disconnection or other. The LED indicators usually are disposed in the insulating bracket and exposed to a front mating surface. In some side-by-side connector assembly or stacked connector assembly, two or more indicators are assembled beside the connectors, which may cause confusion resulted from light interference with each other due to divergence of lights, giving users a wrong indication.

In view of the above, a novel electrical connector that overcomes the above-mentioned disadvantages is desired.

SUMMARY OF THE INVENTION

Accordingly, an object of the present invention is to provide an electrical connector assembly with a better performance of an LED display.

To fulfill the above-mentioned object, an electrical connector assembly comprises a bracket arranged along a longitudinal direction thereof with a plurality of connector ports and a LED port opening forwards, a plurality of electrical connectors retained in the connector ports, a shading board disposed with a plurality of cavities and a circuit board retained behind and parallel to the shading board and disposed with a plurality of LEDs on a front face thereof. The plurality of LEDs is received in corresponding cavities of the shading board. The shading board with the circuit board is retained in the LED port by the shading board in a height direction perpendicular to the longitudinal direction.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
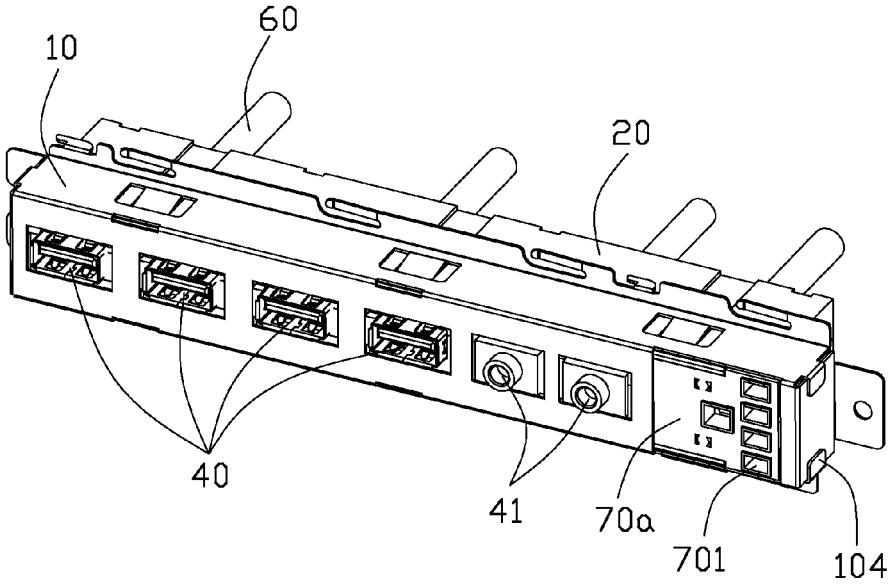
FIG. 1 is a perspective view of an electrical connector assembly according to the present invention.
Figure 2:
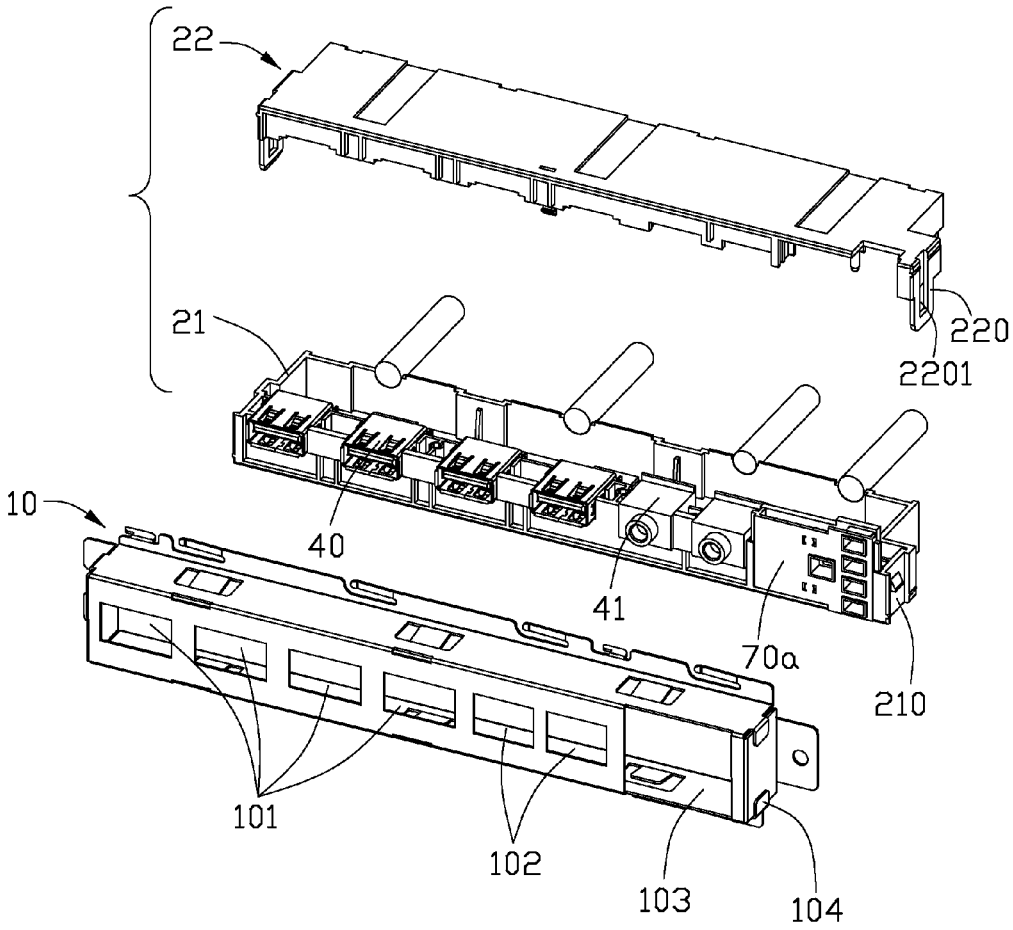
FIG. 2 is an exploded perspective view of the electrical connector assembly of FIG. 1.
Figure 3:
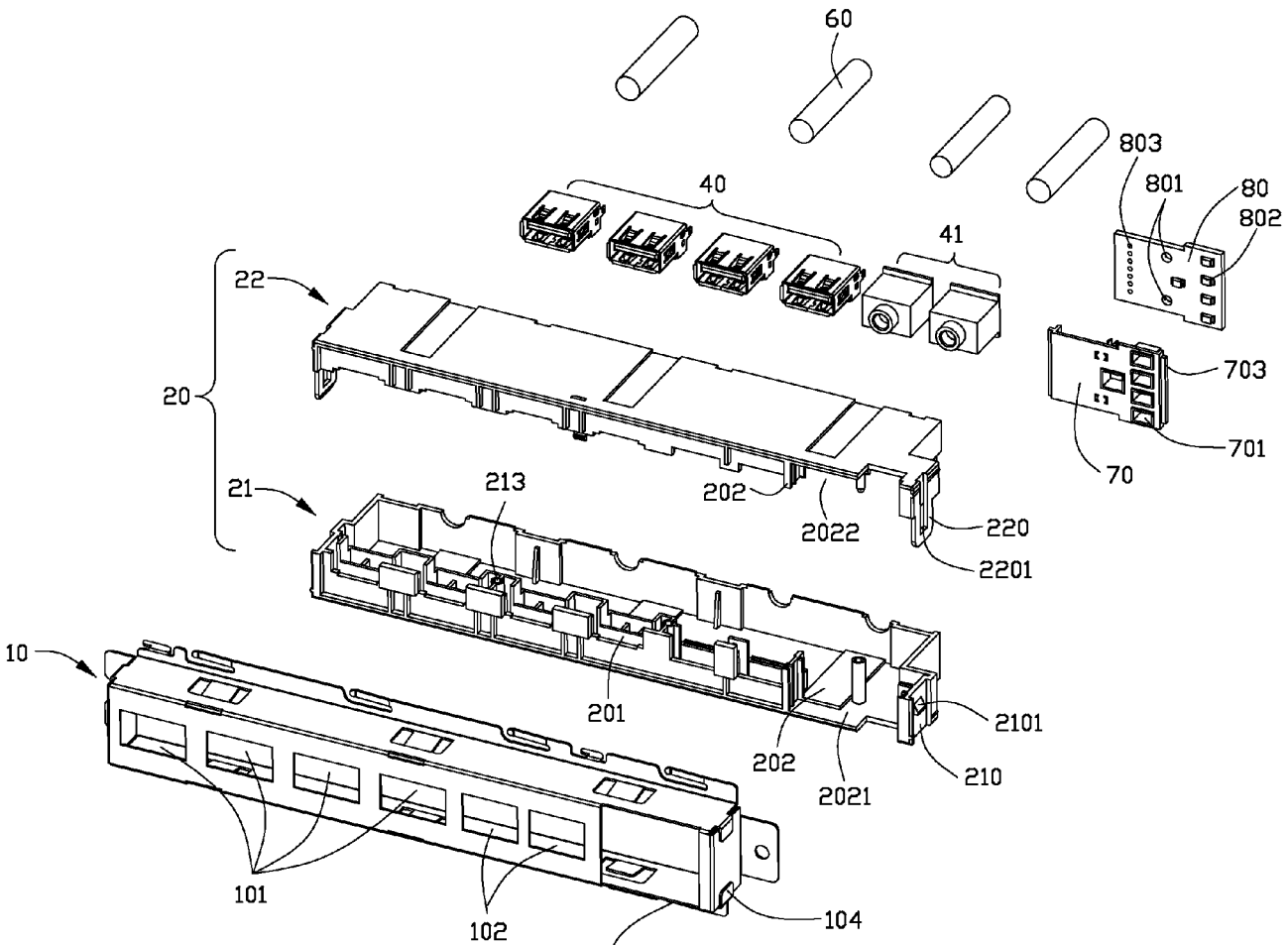
FIG. 3 is an exploded perspective view of the electrical connector assembly of FIG. 1.
Figure 4:
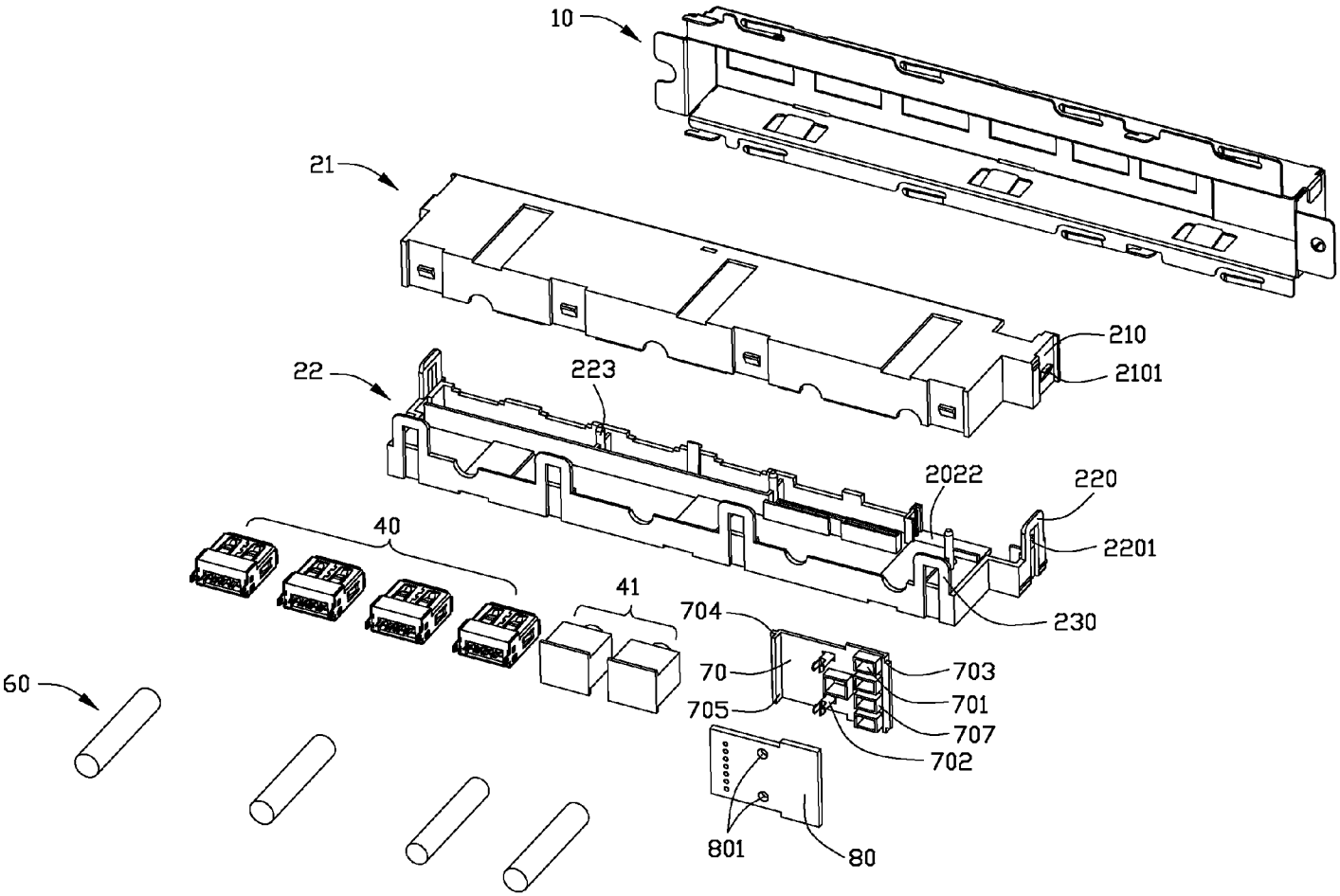
FIG. 4 is an exploded perspective view of the electrical connector assembly of FIG. 1 from another view.
Figure 5:
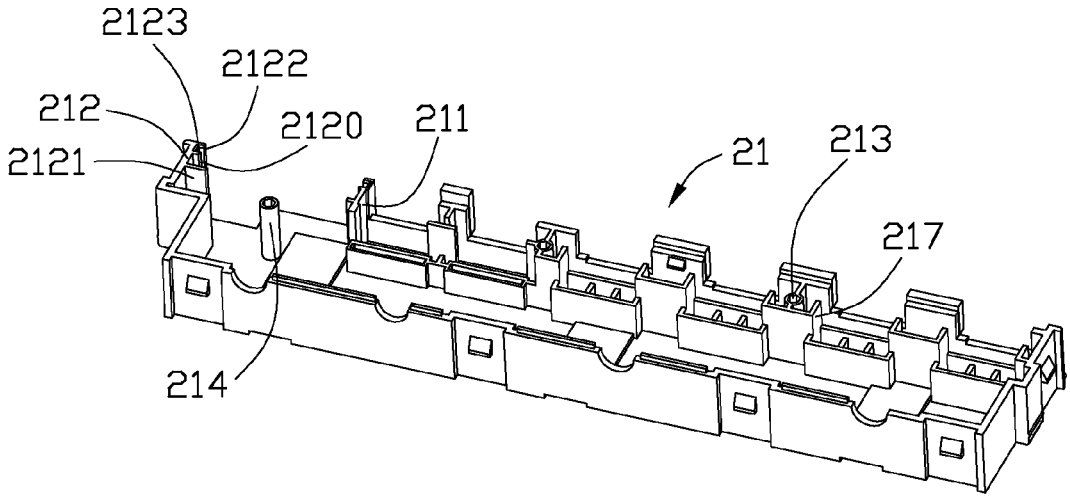
FIG. 5 is a perspective view of the lower portion of the insulating bracket.
Figure 6:
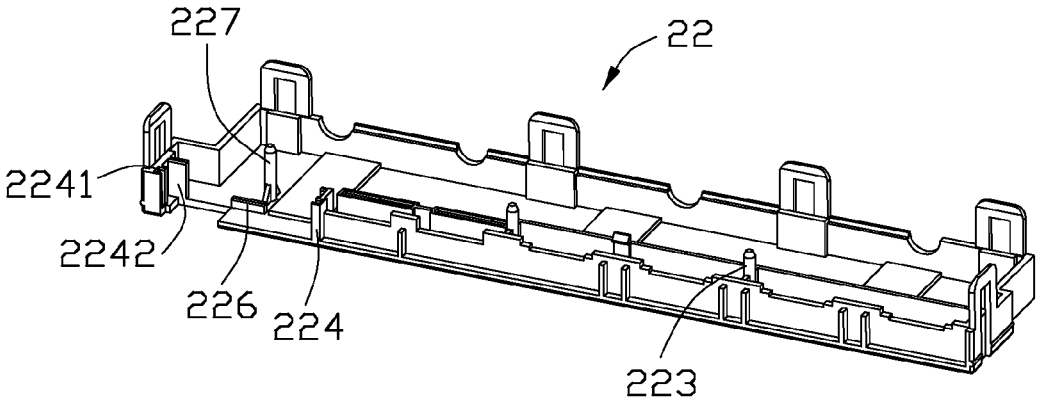
FIG. 6 is a perspective view of the upper portion of the insulating bracket.
Figure 7:
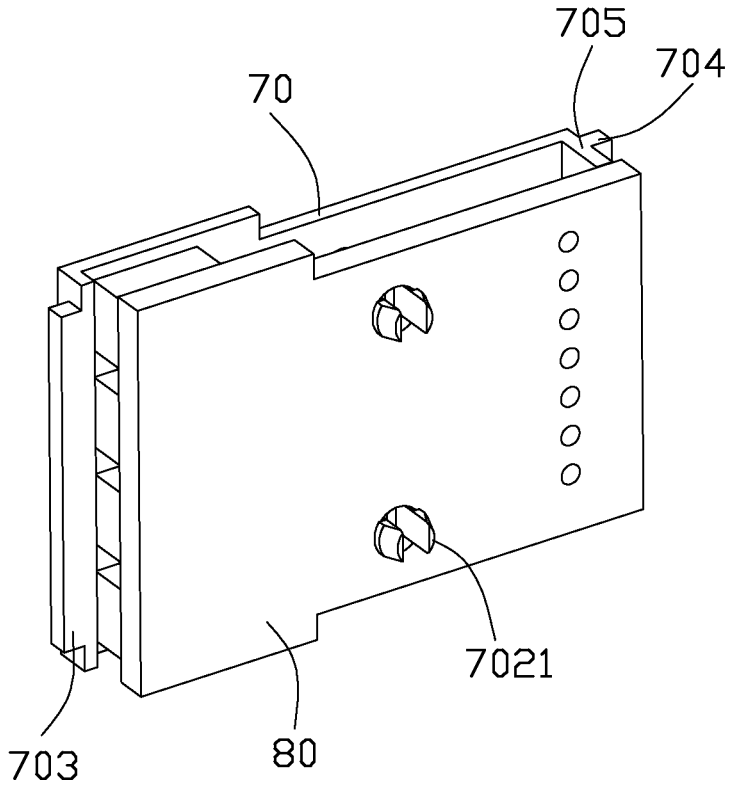
FIG. 7 is a perspective view of the LED display.

Referring to FIGS. 1~2, an electrical connector assembly according to one embodiment of this present invention includes an insulating bracket 20 assembled with a plurality of electrical connectors 40, 41 and an LED display 70*a*. The plurality of electrical connectors includes two audio jacks 41 adjacent to the LED display 70*a* and three USB 2.0 connectors 40 adjacent to the audio jacks, all of the connectors are terminated to cables 60. Said connectors 40, 41 and the LED display 70*a* are arranged side by side along a longitudinal direction or a first direction, and separated from each other and orienting forwards. A metal shell 10 encloses the insulating bracket 20 from a front of the bracket and disposed with corresponding opening 101, 102, 103 to expose the connectors 40, 41 and the LED display 70*a*. The ears 104 bending from the shell 10 are retained on the bracket to assemble the shell 10 to the insulating bracket 20.

Referring to FIG. 3 through FIG. 6, the insulating bracket 20 includes engaged lower case 21 and upper case 22. The lower case 21 defines a lathing recess 210 with a locking tab 2101 therein at each end thereof along the longitudinal direction. The upper case 22 defines a latching arm 220 extending downwards at each end thereof along the longitudinal direction which is inserted in the latch recess 210, with a slot 2201 locking with the locking tab 2101, thereby assembling the two cases 21, 22 together. Similar structures 230 to the locking structure 210, 220 are disposed along a back side of the brackets 20 to further retain the two half cases 21, 22.

The bracket 20 defines a plurality of connecting ports 201 and a LED port 202 along the longitudinal direction to accommodate with the connectors 40, 41 and the LED display 70*a*, which each are formed by combination with half opens (such as half opening 2021, 2022) defined on the two cases 21, 22 respectively. A partitioning wall 217 located between every two adjacent ports 40, 41 is disposed to separate every port, a post hole 213 is defined in the partitioning wall 217 of the lower case 21 and a post 223 is defined in the partitioning wall 217 of the upper case 22 which is inserted into corresponding post hole 213 to guide insertion and retain said two cases 21, 22.

The LED port 202 is surrounding by one partitioning wall 217 and a side wall of the shell 10, which are named as supporting walls 211, 212, each supporting wall extending in the front-to-back direction and the height direction which two are perpendicular to the longitudinal direction and adjacent to a front edge of the lower case 21. The supporting walls in the preferred embodiment are mainly formed in the lower case 21. Two pairs of short or first ribs 2120, 2122 extend toward each other from the supporting walls, thereby a pair of vertical groove 2123 are defined between the pairs of the short ribs 2120, 2122, the front pair of short ribs 2122 are flushed with the from walls of the cases. A pair of longer or second ribs 2121 extending toward each other from the supporting walls is located behind the short ribs 2120, 2122. A positioning post 214 with holes is located among the said ribs 2120, 2122. The upper portion 22 defines complementary supporting walls 224 with ribs 2241, 2242. Moreover, a longitudinal rib 226 is disposed between said two longer ribs 2121 and a post 227 is defines among said ribs 2120, 2122, 2121. Said construct are disposed for fitly assembly the display 70*a* in the LED port 202.

The LED display 70*a* includes a printed circuit board (PCB) 80, which is arranged with a row of separated LEDs 802 adjacent to a side thereof in the height direction and disposed with a row of through holes 803 at opposite side thereof. Two larger holes 801 are located in a substantially middle of the PCB in the height direction. The shading board 70 defines a corresponding row of rectangular cavities 701 and two retaining posts 702. The LEDs 802 are received in the rectangular cavities 701 and the retaining posts 702 are received in the larger or first holes 801 when the PCB 80 is attached behind the shading board 70. The free ends 7021 of the posts are in the fork shape, thereby the posts 702 are interfering with the larger holes 801. The cavities 701 are formed in well portions 707 projecting rearwards and through a front face of the shading board 70, the LEDs 802 are received in the well portions 707 to shield divergence of lights of the LEDs 802. The shading board 70 further extends two flanges 703, 704 at opposite edges thereof in the longitudinal direction.

The flanges 703, 704 slide into the grooves 2123 of the lower case 21 from a top thereof, thereby the display 70*a* is limited in the grooves 2123 by the short and longer ribs 2120, 2122, 2121 in the front-to-back direction. Then, corresponding grooves (not labeled) of the upper case 22 slide along the flanges 703, 704 to receive the flanges therein. The longer ribs 2123 and longitudinal rib 226 are located behind a back of the PCB 80 to further limit the display 70*a*. The shading board 70 defines a pressing rib 705 equal to the well portions 707 in the front-to-rear direction so as to press against the PCB 80. The posts 223, 227 of the upper case 22 are fitly inserted in the post holes 213, 214 of the lower case 21 and the locking arms 220 are retained with the locking recess 210. Therefore, the lower and upper cases 21, 22 are fitly assembled together. Said electrical connectors and LED display 70*a* are fitly retained in the bracket 20 to be as a unit.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulative bracket arranged along a longitudinal direction thereof with a plurality of connector ports and a LED (Laser Emitting Diode) port orienting forwards;

a plurality of electrical connectors retained in the connector ports;

a circuit board disposed with a plurality of LEDs on a front face thereof, the circuit board being retained in the LED port;

wherein a shading board is provided in front of and retained with the circuit board, the shading board defines a plurality of cavities to receive the LEDs so as to avoid light leakage;

wherein the shading board defines a plurality of well portions projecting rearwards and pressing against the printed circuit board, said cavities are defined on the well portions respectively; and wherein the shading board defines two flanges at opposite sides thereof, the bracket defines two supporting walls forming said LED port and two pair of short ribs extending toward each other from the supporting walls respectively thereby defining a pair of vertical grooves to accommodate with the flanges of the shading board.

2. The electrical connector assembly as claimed in claim 1, wherein the supporting walls define a pair of longer ribs behind the printed circuit board.

3. The electrical connector assembly as claimed in claim 2, wherein the shading board defines two posts with fork-shaped free ends which are interfering with the corresponding post holes defined in the printed circuit board.

4. The electrical connector assembly as claimed in claim 3, wherein said LEDs are arranged in one row in the height direction.

5. An electrical connector assembly comprising:

a bracket defining a front face;

a plurality of electrical connectors and a LED (Laser Emitting Diode) display side-by-side located the bracket and opening in the front face of the bracket;

wherein the LED display comprises a circuit board and a shading board covering on a front face of the circuit board, the shading board defines a plurality of well portions to receive corresponding LEDs attached on the front face of the circuit board thereby the LEDs exposing to the front face of the bracket;

wherein the plurality of LEDs are arranged in one row distant from said electrical connectors; and wherein the shading board defines opposite side flanges slide in vertical grooves defined in the bracket.

6. An electrical connector assembly comprising:

a bracket including opposite upper and lower cases each extending in a longitudinal direction while commonly assembled to each other in a vertical direction perpendicular to each other;

a plurality of cavities formed in the bracket;

a plurality of electrical connectors disposed in the corresponding cavities, respectively;

a plurality of openings formed in a front face of the bracket and in alignment with the corresponding cavities in a front-to-back direction perpendicular to both said longitudinal direction and said vertical direction, respectively, through which the corresponding connectors communicate with an exterior forwardly; and an LED (Laser Emitting Diode) display received in another cavity in the bracket beside said connectors, said LED display including at least one printed circuit board with a plurality of LEDs thereon; wherein said printed circuit board is disposed in said another cavity and perpendicular to said front-to-back direction;

wherein a plurality of cables extend behind a rear face of the bracket and are connected to the corresponding connectors and the printed circuit board; and wherein the LED display is sandwiched between the upper case and the lower case.

7. The electrical connector assembly as claimed in claim 6, wherein said LED display further includes a shading board pre-assembled with the printed circuit board in a parallel relation with the LEDs therebetween in the front-to-back direction before the LED display is assembled into the corresponding cavity, and said shading board is essentially coplanar with the front face of the bracket and defines a plurality openings in alignment with the corresponding LEDs, respectively.

8. The electrical connector assembly as claimed in claim 7, wherein the shading board is coplanar with the front face of the bracket.

9. The electrical connector assembly as claimed in claim 7, wherein the openings, which is aligned with the corresponding LEDs, are formed by corresponding well portions extending between the shading board and the printed circuit board.

10. The electrical connector assembly as claimed in claim 6, wherein said another cavity is located around an end of the bracket in the longitudinal direction.

* * * * *